US008755549B2

(12) United States Patent
Zhao et al.

(10) Patent No.: US 8,755,549 B2
(45) Date of Patent: Jun. 17, 2014

(54) UNIVERSAL FLEXIBLE IN-THE-EAR HEARING AID

(75) Inventors: Yong David Zhao, Changshu (CN); Jennifer Jinping Zhao, Changshu (CN)

(73) Assignee: Jiangsu Betterlife Medical Co., Ltd, Changshu (CN)

( * ) Notice: Subject to any disclaimer, the term of this patent is extended or adjusted under 35 U.S.C. 154(b) by 69 days.

(21) Appl. No.: 13/505,745

(22) PCT Filed: Jul. 19, 2010

(86) PCT No.: PCT/CN2010/001080

§ 371 (c)(1),
(2), (4) Date: May 3, 2012

(87) PCT Pub. No.: WO2012/006761

PCT Pub. Date: Jan. 19, 2012

(65) Prior Publication Data

US 2012/0219168 A1 Aug. 30, 2012

(30) Foreign Application Priority Data

Jul. 13, 2010 (CN) ..... 2010 10 0224592

(51) Int. Cl.
*H04R 25/00* (2006.01)

(52) U.S. Cl.
CPC ..... *H04R 25/656* (2013.01); *H04R 25/60* (2013.01)
USPC ..... 381/328; 381/324

(58) Field of Classification Search
CPC ..... H04R 25/00; H04R 25/60; H04R 25/602; H04R 25/604; H04R 25/608; H04R 25/65; H04R 25/656
USPC ..... 381/23.1, 312, 322, 324, 328, 380, 381
See application file for complete search history.

(56) References Cited

U.S. PATENT DOCUMENTS 4,539,440 A 9/1985 Sciarra
2012/0140976 A1 * 6/2012 Birger et al. ..... 381/381

FOREIGN PATENT DOCUMENTS

WO 2009/063096 5/2009

OTHER PUBLICATIONS

International Search Report of PCT/CN2010/001080.

* cited by examiner

*Primary Examiner* — Tuan D Nguyen

(57) ABSTRACT

The present patent application discloses a universal flexible in-the-ear hearing aid, comprising a front portion of the hearing aid, a middle portion of the hearing aid and a rear portion of the hearing aid, the front portion of the hearing aid including a speaker, the rear portion of the hearing aid including a main body, the middle portion of the hearing aid including the sound transmission device, the sound transmission device is a flexible or soft-connection device, a end of the soft-connection device connected to the front portion of the hearing aid, another end of the soft-connection device connected to the rear portion of the hearing aid.

11 Claims, 9 Drawing Sheets

UNIVERSAL FLEXIBLE IN-THE-EAR HEARING AID

TECHNICAL FIELD

The present patent application relates to a hearing aid device, in particularly relates to a universal in-the-ear hearing aid, an in-the-ear hearing aid device which is able to be free adjust its 3-dimension curved angle and length in ear canal.

BACKGROUND

At present, the companies supplying the digital hearing aid normally focus their attention on increasing the power of the hearing aid for obtain more higher audio outputting signal, or by suing the way of suppressing the environment noise or eliminating echoing sound signal, etc, to ensure the quality of the outputting signal. The consequence is that: even the quality of the outputting signal is very good, however the gain portion in the user actually received signal is quite less so that the user still cannot obtain a good listening effect. Normally, a customized hearing aid is put on the auricle of the user, a behind-the-ear aid is put behind of the ear of the user, and there is a distance between the sound from the speaker and the eardrum of the user. The interaction between the resistance of the sound transmission and sound deflection made sound loss when the sound is transmitted in the ear canal with complicated physiological structure. In general, there is about 20%~30% gain loss so that many severe hearing loose patient complaining the power of the hearing aid being not enough.

For enhancing the wording efficiency and improving the invisibility of wearing, completely-in-the-canal (CIC) hearing aid or in-the-ear hearing aid is created, so that reduced the loss which happened during the transmission in ear. Thanks to the volume of the in-the-ear hearing aid is very small, the room for arranging the parts is very limited, so must design and make the parts as small as possible, meantime the assembly should be quite impact. The disadvantage caused by smaller size is power of the hearing aid has to reduce accordingly; the sound gain effect is expected cannot be great.

Completely-in-the-canal (CIC) hearing aid is a kind of hearing aid customized, need to take ear-impression for each hearing-impaired patient in fitting centre in advance, then sending the ear-impression to the plant and manually make as the housing of the hearing aid. Thanks to the main body of the hearing aid does not exposed outside of ear, its invisibility being very high is a object which is pursued by part of hearing-impaired patients, however, rather because it being put inside of the ear, the adverse effect could be produced would be occlusion effect, echo howround, effecting to the wearing stability which resulted from the hard contacting with the whole ear canal and not adapting the movement of the muscle of ear canal, and the difficulty of cannot be put in depth ear canal which resulted from the complicated 3-dimensioned physiology-anatomy structure, etc.

For letting the fitting centre can obtain the common acknowledge when they are filling the "customized hearing aid customer order", give convenient to the fitting centre when they select the ear canal length of the customized hearing aid, improving the success rate of their first time fitting, especially, the literal report gives standard definition to the 3-dimensioned physiology-anatomy structure. Hereby, by taking reference to FIG. 12, explaining short ear canal 21, middle length ear canal 22, long ear canal 23, deep ear canal 24, etc.

Short ear canal 21: Not exceed the central line of the first curved conduit and the second curved conduit (generally, suit for the hearing aid fitting patient whose hearing impairing rather small, not suit to CIC patient)

Middle length ear canal 22: exceed the central line of the first curved conduit and the second curved conduit, not exceed the second curved conduit (suit for the hearing aid fitting patient whose hearing impairing not very severe, but not suit to CIC patient)

Long ear canal 23: exceed the second curved conduit about 1 mm (suit for the hearing aid fitting patient whose hearing impairing is somehow severe, or suit to CIC patient)

Deep ear canal 24: exceed the second curved conduit 3~5 mm (suit for the hearing aid fitting patient whose hearing impairing very severe and reach the limitation of hearing aid fitting, not suit to the situation of the curvature of the second curved conduit of the patient is very large, the situation of loss of hearing is quite good, or the old aged ITE selecting patient)

Universal in-the-ear hearing aid is the new completely-in-the-canal (CIC) hearing aid which developed in the recent years on the base of common customization, there is no need for each patient take the ear-impression and special manual manufacture for such a hearing aid. However, its positioning in the ear canal mainly depends on the earplug with greater protrusion end, hard plastic main body hardly contact with the ear canal and slides along with movement of the muscle of ear canal caused by the activity like talking, eating, drinking etc. The main problem is that it is hardly extending into the depth of ear canal, can not eliminate the occlusion effect and echo howround, the wearing stability and extent of comfort is rather bad.

U.S. utility patent numbered by U.S. Pat. No. 7,092,543B1 discloses a common in-the-ear hearing aid, as shown in FIG. 13, the speaker portion of this in-the-ear hearing aid is able rotate flexibly, belongs the in-the-ear hearing aid which suit for use in anybody's ear canal, its speaker extending into the inside of ear, comparatively closer to human eardrum located in depth of ear canal, reduced the gain loss which caused during the sound transmission in the ear canal, improved the work efficiency of the hearing aid. A fixed pulling line or pole disposed at the rear end of the in-the-ear hearing aid, made the taking out of it is very convenient. However, the angle of elevation of the speaker portion is not larger than 30 degree, can not adapt to the requirement of turning angle of the human ear canal is up to 60 degree; There is no air circulation near the central part of ear canal during use and sweating situation exist, so as to make the user feels not comfortable, also it is hardly to be put to where is close r to human eardrum.

FIG. 14 is a structure illustrative view of a universal in-the-ear hearing aid supplied by UNITRON, its stent maintain a space from the ear canal, ensured the air circulation in ear, there is no sweating although long time wearing, and the speaker is closer to human eardrum, reduced the gain loss which caused during the sound transmission in the ear, improved the work efficiency of the hearing aid. A pulling pole disposed at the rear portion of this in-the-ear hearing aid, so as to convenient the taking out of the hearing aid. However, its sound transmission device is a rigid connection, in such, the hearing aid will often meets the following situation during use: The outer housing of in-the-ear hearing aid is a rigid housing with unchangeable shape, when it is put in the ear of human, resulting from difference in the length and shape of the ear canal, a non-even contacting exist between the outer housing and the ear canal, some portion of ear canal exerted very high pressure, made the user feel uncomfortable. Its positioning mainly depends on the earplug with protruded end, the hard plastic made main body hardly contact with the ear canal and slides along with the movement of the muscle of ear canal. The main problem is that it cannot bend, cannot extended into the ear canal with complicated 3-dimensioned structure, cannot eliminate the occlusion effect and echo howround, the stability of wearing and extent of comfortable is very bad.

SUMMARY

Directed towards the forgoing product drawbacks which cannot meet the requirement of the market, the present patent application aiming at supplying a universal flexible in-the-ear hearing aid, which not only having the advantage of the in-the-ear sound receiving behind-the-ear aid and universal in-the-ear hearing aid, easy putting to the depth of ear canal where is closer to human eardrum, wearing stable and comfort, there is air circulation in ear when wearing, without sweating of long time wearing, eliminated occlusion effect and echo howround, clear sound transmission, less gain loss, it's a kind of flexible in-the-ear hearing aid which is suitable for all kinds of hearing-impaired patients.

The technical solution to solve the problem as: A universal flexible in-the-ear hearing aid, comprising a comprising a front portion of the hearing aid, a middle portion of the hearing aid and a rear portion of the hearing aid, the front portion of the hearing aid including a speaker, the rear portion of the hearing aid including a main body, the middle portion of the hearing aid including the sound transmission device, the sound transmission device is a flexible or soft-connection device, a end of the soft-connection device connected to the front portion of the hearing aid, another end of the soft-connection device connected to the rear portion of the hearing aid.

In one preferred embodiment of the present patent application, in which the soft-connection device detachable connected to the front portion of the hearing aid and the rear portion of the hearing aid, alternatively, they non-detachable connected together.

In one preferred embodiment of the present patent application, in which the soft-connection device being a soft hose structure.

In one preferred embodiment of the present patent application, in which the material of the soft hose structure being single or composite materials, medical or non-medical grade elastic material, non-metallic or metallic elastic material.

In one preferred embodiment of the present patent application, in which the length and extent of curve the soft hose structure may altered and freely controlled according to ear canal physiology-anatomy structure.

In one preferred embodiment of the present patent application, in which the outer wall or inner wall or the whole wall of the soft hose structure formed in any shape of waved shape, or in screwed shape, straight strips or declined strips.

In one preferred embodiment of the present patent application, in which the front portion of the hearing aid also including an elastic stent, the speaker in whole or in part set in the inside of the stent, a space left between the stent and the wall of the ear canal.

In one preferred embodiment of the present patent application, in which the main body composed by function components and the external housing of the main body, the function components disposed in the external housing of the main body, the external housing of the main body made of the material of single or composite materials, medical or non-medical grade material, non-metallic or metallic material, elastic or non-elastic material.

In one preferred embodiment of the present patent application, in which a pulling line or pole disposed at the rear portion of the main body. The material of the pole could be single or composite materials, medical or non-medical grade material, non-metallic or metallic material, elastic or non-elastic material.

In one preferred embodiment of the present patent application, in which one or multiple elastic ring, or completely or partly covered by an elastic shield, the elastic ring or the shield is made of single or composite materials, medical or non-medical grade material, non-metallic or metallic elastic material.

The in-the-ear hearing aid disclosed by the present patent application, thanks to comprising a front portion of the hearing aid, a middle portion of the hearing aid and a rear portion of the hearing aid, the middle portion of the hearing aid is made up of a flexible hose, the length and the curving angle of the flexible hose may be free controlled, letting the user wearing comfortably, in such, realized a universal in-the-ear hearing aid which is suitable for the patients who have the different physiology-anatomy structured ear canal; Besides, via the design of the flexible hose in the middle portion and the stent in the front portion, made it keep a distance from the wall of the ear canal, ensured the air circulation in ear, long time wearing and no sweating, its speaker is closer to human eardrum, sound transmitting clearly. Outside of the main body, a elastic rubber ring may disposed thereon, made there is a always contact between the hearing aid and the ear canal, make the wearing stable, avoided the hearing aid slides relative the ear canal when muscle is moving.

DETAILED DESCRIPTION

For an easy understanding to the technical personnel to the advantages and features of the present patent application, the following a detailed description made by reference to the drawings of the preferred embodiments so that make a more specified definition to the protection scope of the present patent application.

Figure 1:
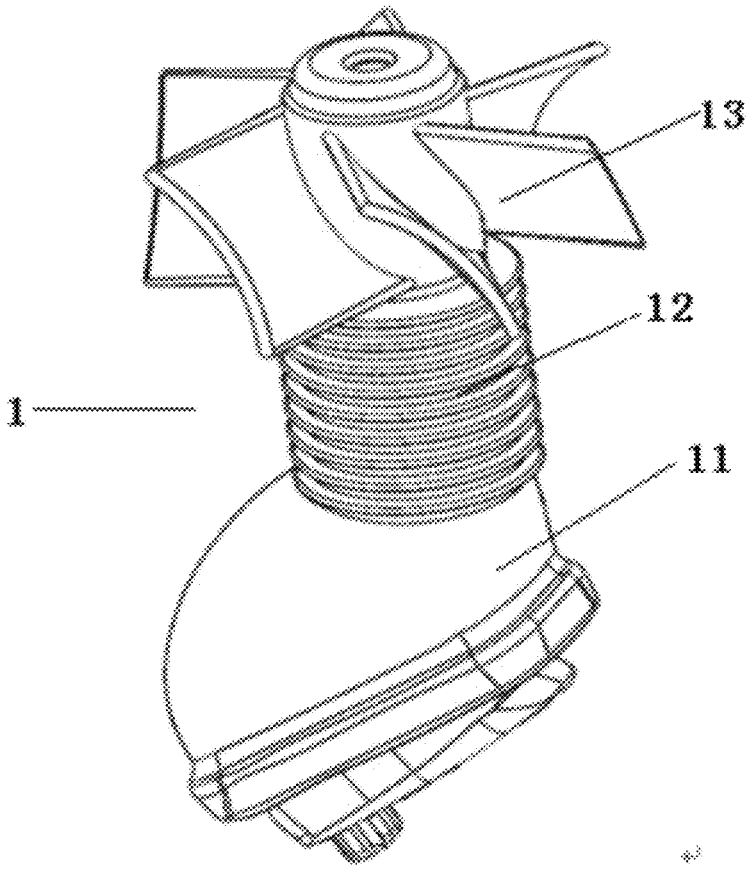
FIG. 1 is a schematic view of the structure of one embodiment of the in-the-ear hearing aid of the present patent application.
Figure 3:
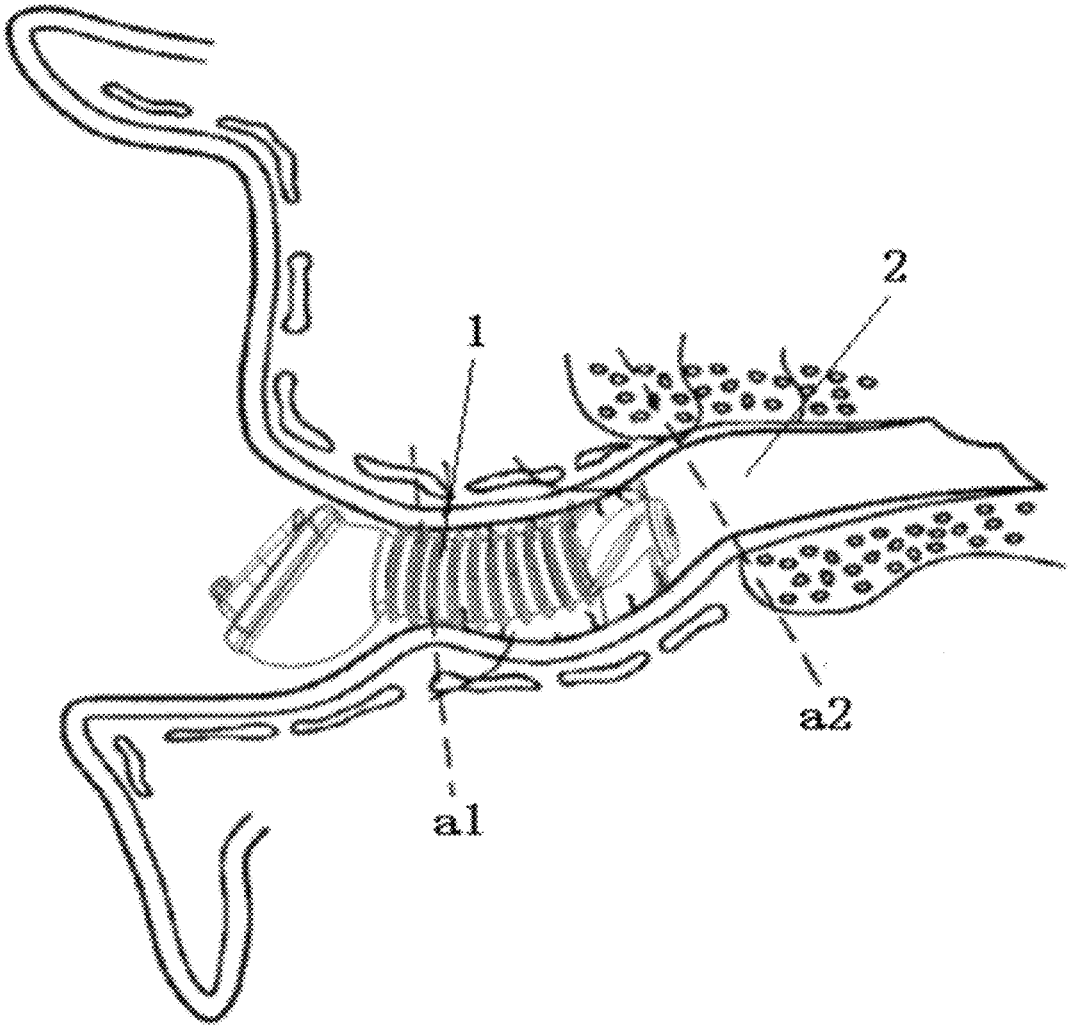
FIG. 3 is a schematic view of the structure of one embodiment of the in-the-ear hearing aid of the present patent application in using state (ear canal front view)
Figure 4:
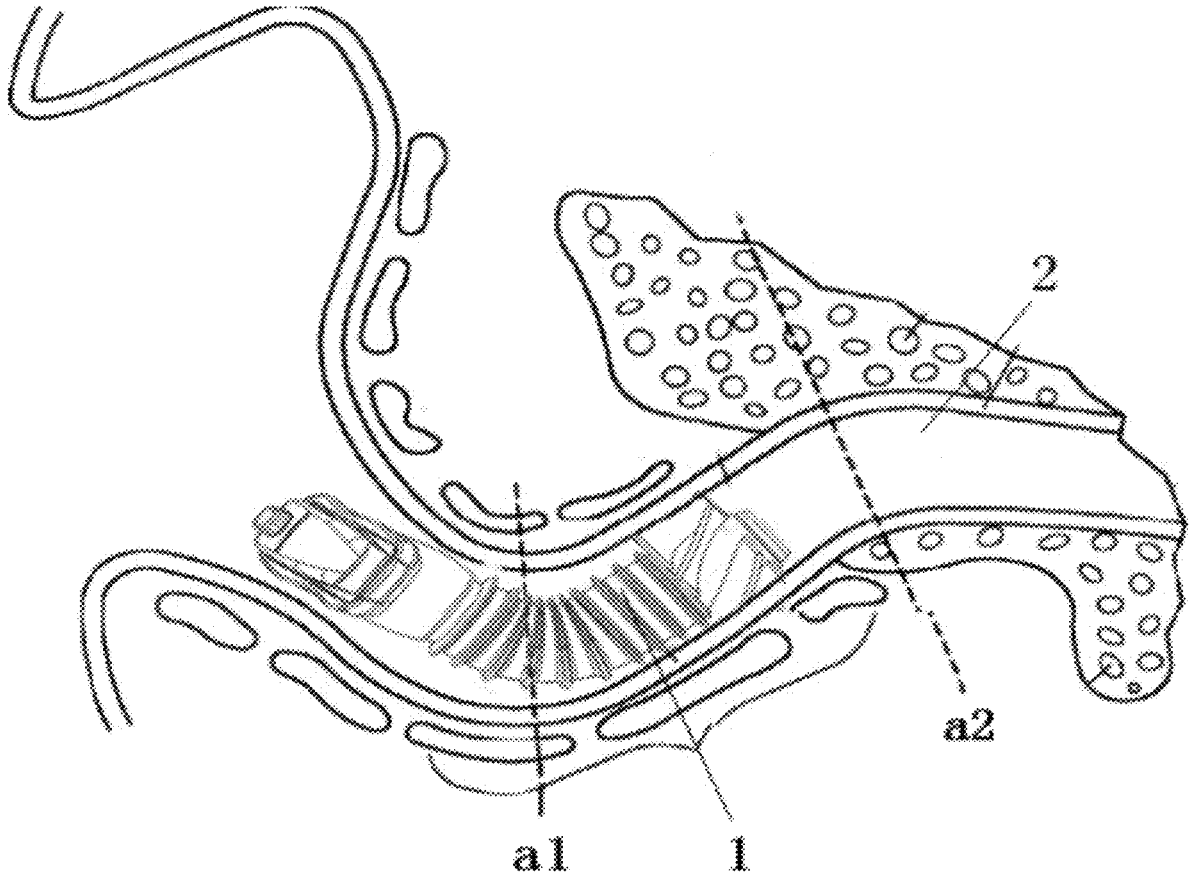
FIG. 4 is a schematic view of the structure of one embodiment of the in-the-ear hearing aid of the present patent application in using state (ear canal top view)

As shown in FIG. 1, illustrated a universal in-the-ear flexible hearing aid 1, it comprises a comprising a front portion of the hearing aid, a middle portion of the hearing aid and a rear portion of the hearing aid, here the front portion of the hearing aid including a speaker 17, here the rear portion of the hearing aid including a main body 11, here the middle portion of the hearing aid is formed by a sound transmission device, Wherein, the sound transmission device is a flexible or soft-connection device, a end of the soft-connection device connected to the front portion of the hearing aid, another end of the soft-connection device connected to the rear portion of the hearing aid. As shown in FIG. 3 and FIG. 4, the length and the curving angle of the flexible hose may be free controlled, letting the user wearing comfortably, in such, realized a universal in-the-ear hearing aid which is suitable for the patients who have the different physiology-anatomy structured ear canal.

In the embodiments of the present patent application, the soft-connection device detachable connected to the front portion of the hearing aid and the rear portion of the hearing aid, alternatively, they non-detachable connected together. The way of connection also may be the connection device detachable connected to the front portion of the hearing aid, whereas fixedly connected to the rear portion of the hearing aid, or the connection device fixedly connected to the front portion of the hearing aid and detachable connected to the rear portion of the hearing aid.

Figure 2:
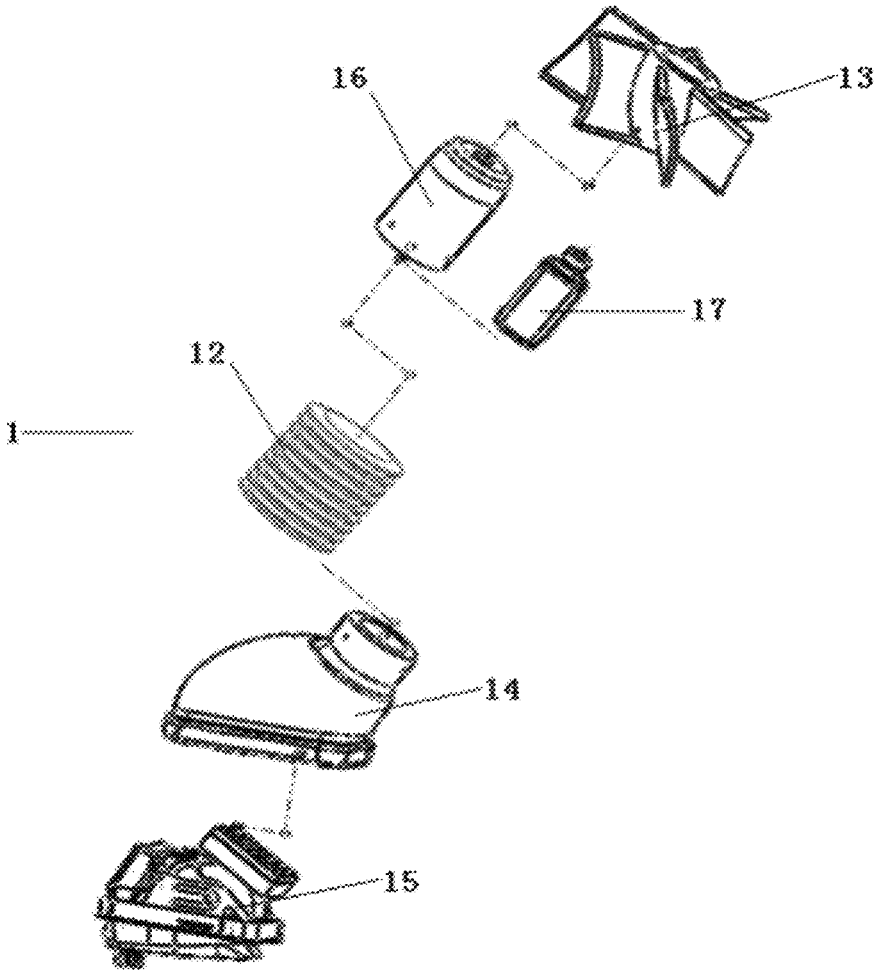
FIG. 2 is a schematic view of the assembly of one embodiment of the in-the-ear hearing aid of the present patent application.

FIG. 2 is a schematic view of the assembly of one embodiment of the in-the-ear hearing aid of the present patent application. In the preferred embodiments of the present patent application, the main body 11 composed by the outer housing of the main body and the functional component 15, the functional component 15 is disposed inside of the outer housing of the main body 14, the functional component 15 includes the components which have the function of the turning on and turning off, the receiving of the audio signal, magnifying, filtering the sound signal, power adjustment, etc. One end of the outer housing of the main body disposed with a connection protrusion hole for the connection to the flexible hose 12, another end of the flexible hose 12 connected to the outer housing of the speaker 16, the speaker 17 disposed inside of the outer housing of the speaker 16, the audio signal transmitted to the speaker 17 via the flexible hose 12, The outside of the outer housing of the speaker 16 coated with a stent 13. Here the outer wall of the flexible hose 12 is in wave shape and the surface of the stent 13 is in spiral shape, the in-the-ear hearing aid preliminarily positioned in ear via the stent 13. A pulling pole 18 disposed at the rear portion of the main body 11 so as to convenient for the taking out of hearing aid. When the hearing aid is in wearing state and working state, the pulling pole may be coiled outside of the door of the battery accommodating room, the head of the pulling pole clipped in a securing slot. When taking out the hearing aid, straighten the pole and then pull out the hearing aid. The material used for making the pole is the high polymer material, such as polyurethane, or silicon rubber. The diameter of the pulling pole is not greater than 3 mm; the length of it is not smaller than 5 mm.

Figure 9:
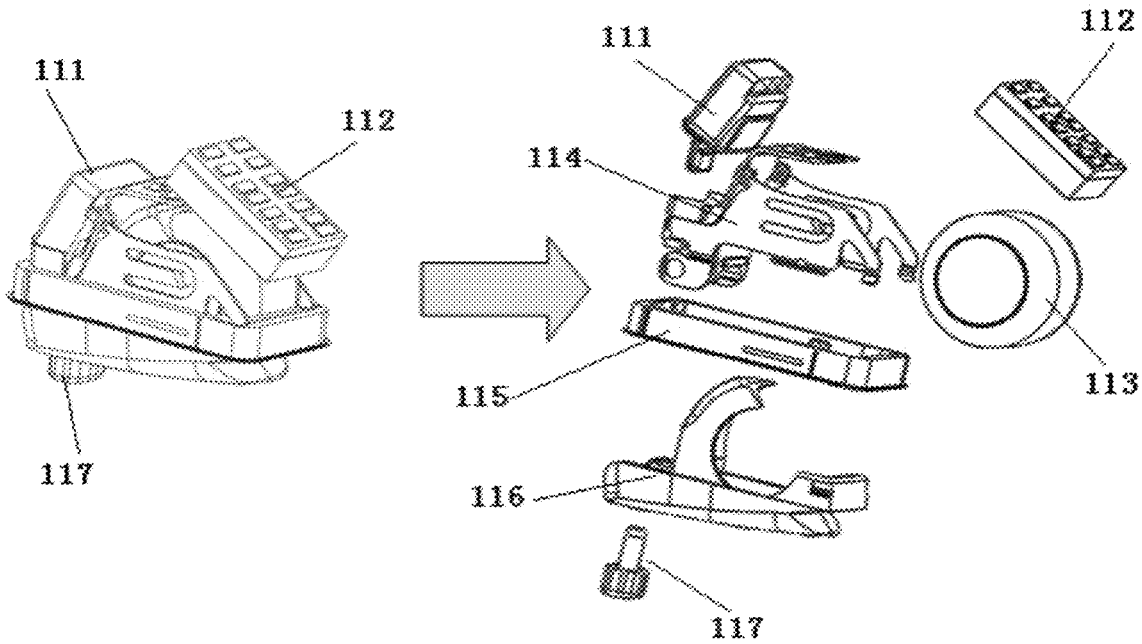
FIG. 9 is the assembly schematic view of the inner structural components of the embodiments of the present patent application.

FIG. 9 is a schematic view of an embodiment of the main body 11 of the present patent application in which the inner structural components assembled together. The functional components composed by a microphone 111, a chip 112, batteries 113, a first structure part 114, a second structure part 115, a third structure part 116, a button 117. When made the assembly, the microphone 111 disposed inside of the first structure part, battery 13 is disposed inside of the third structure part 116; then inserting the third structure part 116 into the first structure part 114 and then connected to the second structure part 115 so that made them formed a whole structural component; the end of the button 117 inserts into the third structure part 116 and reach and contact with the end of the microphone in the first structure part 114, use the button 117 controlling the using state of the microphone 111; Finally, connect the chip 112 to the assembly of the structural parts, and located above the battery 113. The functional component 15 which composed by the structure parts realized the turning on and shifting off, the receiving of the audio signal, magnifying, filtering the sound signal, power adjustment, etc, of course, the assembly of these functional components 15 and the mechanical coordination and positioning of them may take other proper ways, the present patent application do not make limitation on this.

Figure 5:
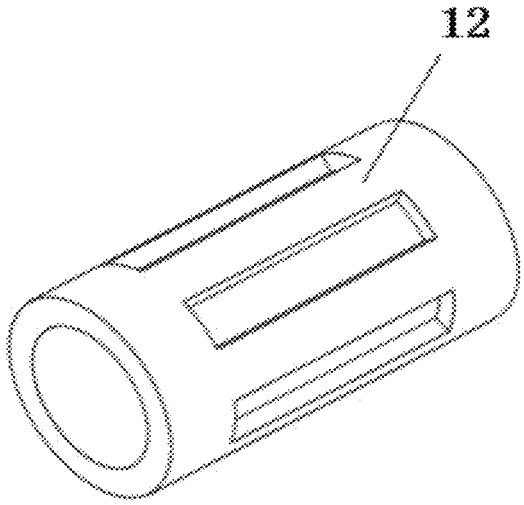
FIG. 5 is a schematic view of the hearing flexible hose of the second embodiment of the in-the-ear hearing aid of the present patent application.
Figure 6:
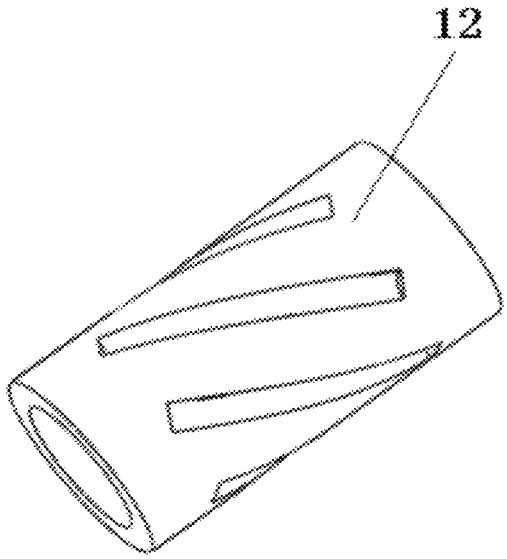
FIG. 6 is a schematic view of the hearing flexible hose of the third embodiment of the in-the-ear hearing aid of the present patent application.
Figure 7:
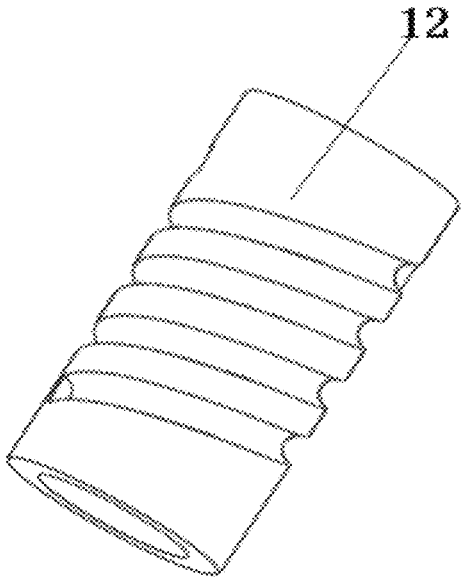
FIG. 7 is a schematic view of the hearing flexible hose of the fourth embodiment of the in-the-ear hearing aid of the present patent application.
Figure 8:
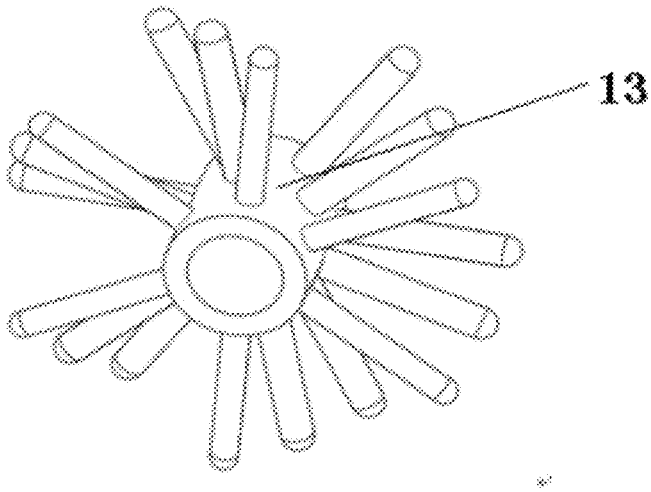
FIG. 8 is a schematic view of the stent of the second embodiment of the in-the-ear hearing aid of the present patent application.

The material of the flexible hose 12 of the present patent application is medical grade elastic material, such as medical grade ETR elastomer Q7-4735, the flexibility is very good so as to make it can be pushed into and seat at the nearby of the second curved conduit a2 where loser to the eardrum, directed towards the ear characters and dimension of different individuals, it can be bent with liberty but no buckling deformation or broken, it is safety for use. The outer surface of the wall of the flexible hose 12 or The inner surface of the wall of the flexible hose 12 is in wave shape, or in any shape of spiral shape, straight strips or inclined strips, as illustrated in FIG. 5, FIG. 6, FIG. 7, hereby there is no limitation to the shape of the flexible hose; The surface of the stent 13 is in spiral shape, or as illustrated in FIG. 8, the outer shape of the flexible hose 12 and the stent can be designed in other shapes and the technical effect is somehow the same, made it keep a distance from the wall of the ear canal, ensured the air circulation in ear, long time wearing and no sweating.

The outer diameter of the flexible hose in the present patent application is less than 8 mm, or alternatively, any shaped flexible hose of which the length of diagonal line of the cross section is less than 8 mm, including the hoses of which the cross section be a polygon with the number of line segments of 3, 4, 5, 6, 7, 8 etc. The hose can be with one hole or multiple holes.

To realize the use of the embodiments of the present patent application in ear, by means of the flexible hose 12 designed in the present patent application, made the putting into ear or pulling out from ear of the hearing aid becoming more easy, positioning in the ear canal via the stent 13, meanwhile the speaker 17 is put to the depth of the ear canal and closer to the human eardrum, so that ensured the sound produced by the speaker 17 directly transmitted to the human eardrum, reduced the gain loss of the in-the-ear hearing aid 1 which happened during the sound transmission in the ear, improved the working efficiency of the in-the-ear hearing aid 1. The material used for making the stent is the high polymer material, the silicon rubber which hardness is less than 60, outer diameter is less than 10 mm.

Figure 10:
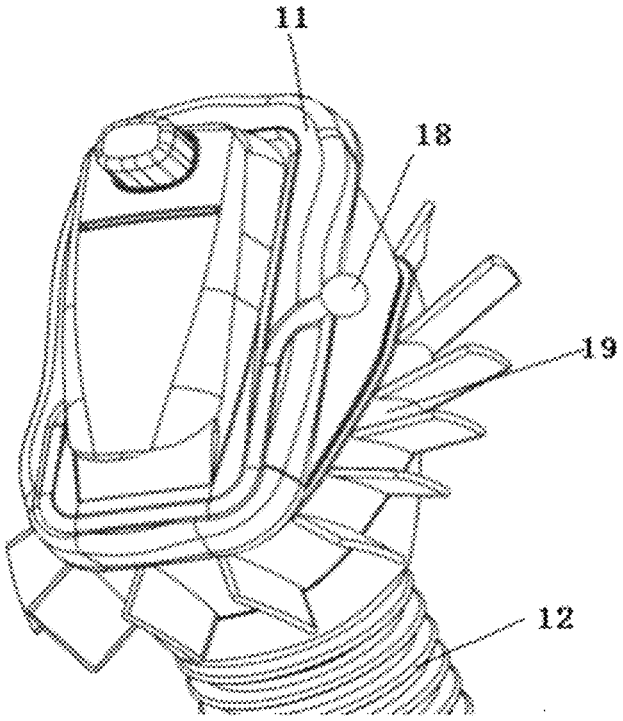
FIG. 10 is a structural schematic view of the first embodiment of the pulling pole of the present patent application.
Figure 11:
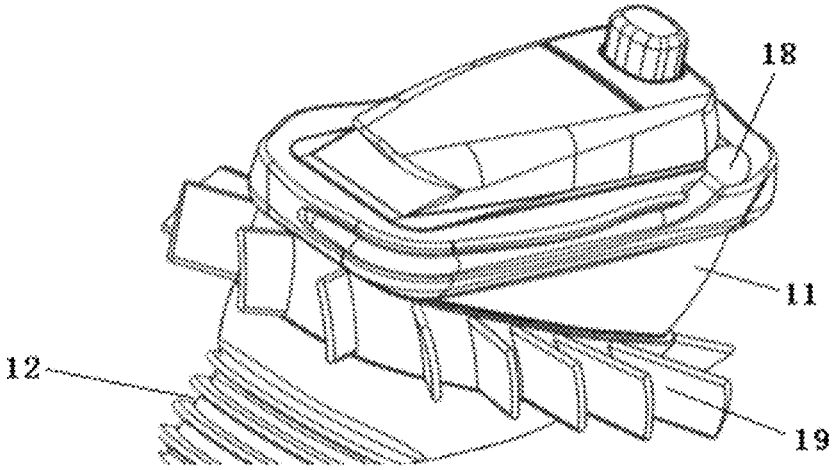
FIG. 11 is a structural schematic view of the second embodiment of the pulling pole of the present patent application.
Figure 12:
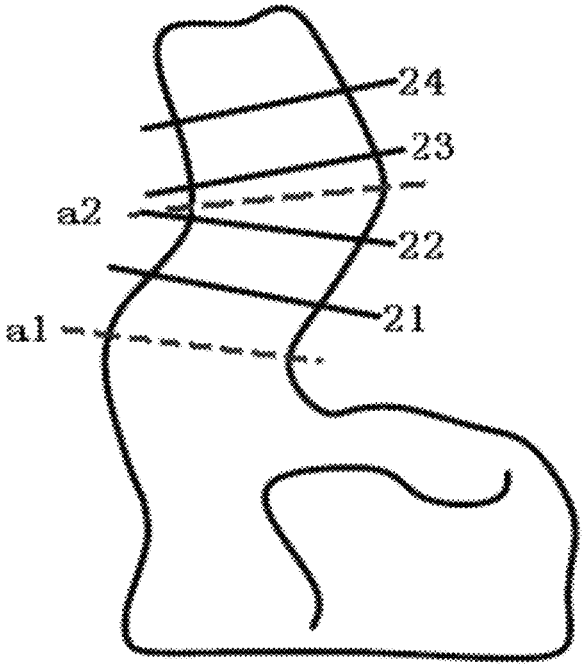
FIG. 12 is a physiology-anatomy structural schematic view of the human ear canal which disclosed in literal report.
Figure 13:
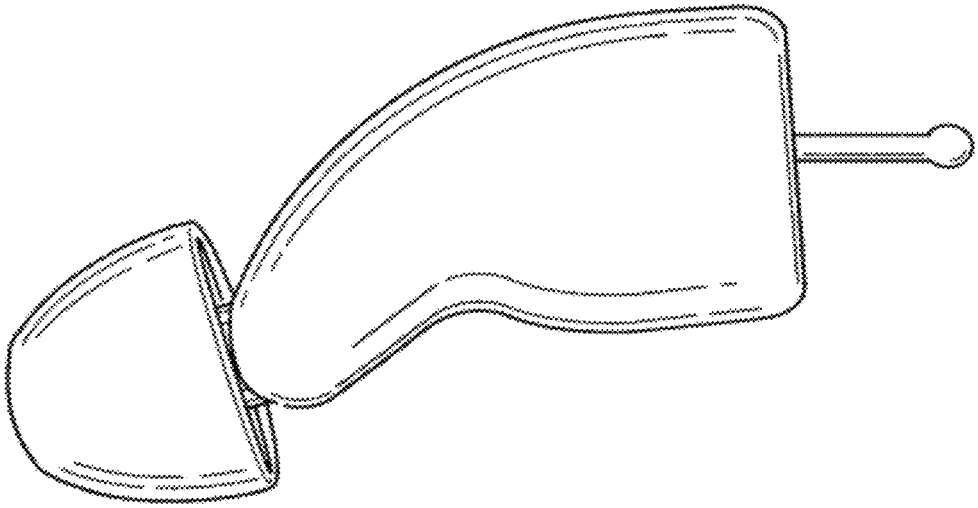
FIG. 13 is the schematic view of a universal in-the-ear hearing aid which disclosed in U.S. patent.
Figure 14:
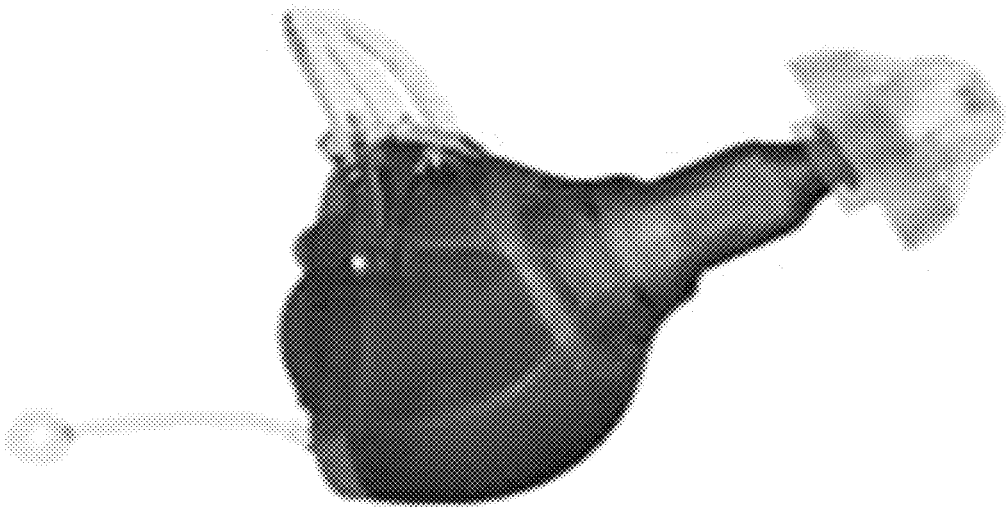
FIG. 14 is the schematic view of a universal new type in-the-ear hearing aid which produced by UNTRON.

FIG. 10 and FIG. 11 are the structure illustrated views of the preferred embodiments I, □ of the in-the-ear hearing aid of the present patent application, the difference lies in: in FIG. 10, the location where put the pulling pole 18 is at the end of the housing; Whereas, in FIG. 11, the location where put the pulling pole 18 is at the side of the housing, of course, it can be put other place as well, for instance, outside of the batter room door, etc. The precondition of the disposal of the pulling pole 18 is convenient the manipulation of the user. The common point of the FIG. 10 and FIG. 11 lies in: a elastic silicon rubber ring 19 may be disposed outside of the main body 11, so as to convenient keep elastic contact with the ear canal, made wearing stable, avoiding sliding movement which can caused by the movement of ear canal muscle relative to the hearing aid, made the wearing more comfortable. Besides, during this elastic silicon rubber ring 19 is designed to contact with the wall of ear canal, may leave a space between the main body 11 of the hearing aid and the wall of ear canal, so as to ensure the air circulation in the ear canal when the hearing aid is wearing, so that improving the comfort ability of the user, as much as possible reducing the sweating in ear canal.

Design of the shape of the elastic silicon rubber ring 19, may be multiple structures, for instance, the elastic silicon rubber ring 19 may be designed to a whole rubber ring and then preserve the air communication hole in the centre of the rubber ring, or make a complete rubber ring in advance, then disposing teeth shaped or protruded portions on the rubber ring, so as to the contacting realized between the protruded portions and the ear canal, in such left the air communication space between the wall of the ear canal and the rubber ring, so that enhanced the comfort ability of the user's human body. The material used for making the elastic silicon rubber ring 19 could be the medical grade elastic material, such as, made by the high polymer silicon rubber material which hardness is less than 60. The outer circumference of the cross section of the elastic silicon rubber ring is less than 50 mm.

The universal flexible in-the-ear hearing aid which disclosed in the present patent application, thanks to comprising a front portion of the hearing aid, a middle portion of the hearing aid and a rear portion of the hearing aid, the middle portion of the hearing aid is made up of a flexible hose, the length and the curving angle of the flexible hose may be free controlled, letting the user wearing comfortably, letting the user wearing comfortably, in such, realized a universal in-the-ear hearing aid which is suitable for the patients who have the different physiology-anatomy structured ear canal; Besides, via the design of the flexible hose in the middle portion and the stent in the front portion, made it keep a distance from the wall of the ear canal, ensured the air circulation in ear, long time wearing and no sweating, its speaker is closer to human eardrum, sound transmitting clearly. Outside of the main body, a elastic rubber ring may disposed thereon, made there is a always contact between the hearing aid and the ear canal, make the wearing stable, avoided the hearing aid slides relative the ear canal when muscle is moving.

The foregoing description, only is the embodiments of the present patent application, however the protection scope of the present patent application is not limited to there. Any alternative solution or replacing solution within the disclosure of the present patent application and made by the person skilled in the art without creative labor covered in the protection scope of the present patent application. Thus, the protection scope of the present patent application should bear the protection scope which limited by the claims.

What is claimed is:

1. A universal flexible in-the-ear hearing aid, comprising a front portion of the hearing aid, a middle portion of the hearing aid and a rear portion of the hearing aid, the front portion of the hearing aid including a speaker, the rear portion of the hearing aid including a main body, the middle portion of the hearing aid including a sound transmission device, the sound transmission device is a flexible or soft-connection device, an end of the soft-connection device connected to the front portion of the hearing aid, another end of the soft-connection device connected to the rear portion of the hearing aid;

wherein the main body composed by function components and an external housing of the main body, the function components disposed in the external housing of the main body, the external housing of the main body made of the material of single or composite materials, medical or non-medical grade material, non-metallic or metallic material, elastic or non-elastic material;

wherein one or multiple elastic ring, or completely or partly covered by an elastic shield, the elastic ring or the shield is made of single or composite materials, medical or non-medical grade material, non-metallic or metallic elastic material;

wherein a shape of the elastic ring is designed to make a complete rubber ring in advance, then disposing teeth shaped or protruded portions on the rubber ring, so as to the contacting realized between the protruded portions and the ear canal, in such left an air communication space between the wall of the ear canal and the rubber ring, so that enhanced the comfort ability of the user's human body.

2. A universal flexible in-the-ear hearing aid as claimed in claim 1, in which the soft-connection device detachable connected to the front portion of the hearing aid and the rear portion of the hearing aid, alternatively, they non-detachable connected together.

3. A universal flexible in-the-ear hearing aid as claimed in claim 2, in which the soft-connection device being a soft hose structure.

4. A universal flexible in-the-ear hearing aid as claimed in claim 3, in which the material of the soft hose structure being single or composite materials, medical or non-medical grade elastic material, non-metallic or metallic elastic material.

5. A universal flexible in-the-ear hearing aid as claimed in claim 4, in which the length and extent of curve the soft hose structure may alter and freely controlled according to ear canal physiology-anatomy structure.

6. A universal flexible in-the-ear hearing aid as claimed in claim 5, in which an outer wall or inner wall or the whole wall of the soft hose structure formed in any shape of waved shape, or in screwed shape, straight strips or declined strips.

7. A universal flexible in-the-ear hearing aid as claimed in claim 1, in which the front portion of the hearing aid also including an elastic stent, the whole speaker or part of it set in the inside of the stent, a space left between the stent and the wall of the ear canal.

8. A universal flexible in-the-ear hearing aid as claimed in claim 1, in which a pulling line or pole disposed at the rear portion of the main body.

9. A universal flexible in-the-ear hearing aid as claimed in claim 1, in which a shape of the elastic ring is designed to a whole rubber ring and then preserve an air communication hole in the centre of the rubber ring.

10. A universal flexible in-the-ear hearing aid as claimed in claim 1, in which a material used for making the elastic ring is made by high polymer silicon rubber material which hardness is less than 60, the outer circumference of the cross section of the elastic ring is less than 50 mm.

11. A universal flexible in-the-ear hearing aid as claimed in claim 1, in which a pulling pole disposed at a rear portion of the main body so as to convenient for the taking out of hearing aid.

* * * * *